US005479869A

United States Patent [19]

Coudon et al.

[11] Patent Number: 5,479,869

[45] Date of Patent: Jan. 2, 1996

[54] OIL SPILL RECOVERY SHUTTLE BARGE SYSTEM

[75] Inventors: Thomas W. L. Coudon, Port Deposit, Md.; George W. Dowell, III, Alexandria, Va.

[73] Assignee: Marine Spill Response Corporation, Washington, D.C.

[21] Appl. No.: 289,560

[22] Filed: Aug. 12, 1994

[51] Int. Cl.[6] ..... B63B 3/08

[52] U.S. Cl. ..... 114/26; 114/74 R; 114/77 R

[58] Field of Search ..... 114/74 R, 77 R, 114/26, 294; 210/242.3; 440/36, 54, 5, 53; 280/414.1

[56] References Cited

U.S. PATENT DOCUMENTS

| | | | |
|---|---|---|---|
| 188,364 | 3/1877 | Hinman | 440/36 |
| 2,314,555 | 3/1943 | Preuss | 114/74 R |
| 2,605,733 | 8/1952 | Smith . | |
| 2,885,990 | 5/1959 | Hawthorne | 440/54 |
| 2,944,352 | 7/1960 | Kaufmann | 114/77 R |
| 2,984,198 | 5/1961 | Atkinson et al. | 114/74 R |
| 3,036,539 | 5/1962 | Storey | 114/77 R |
| 3,704,784 | 12/1972 | Craggs et al. . | |
| 3,756,414 | 9/1973 | Crisafulli . | |
| 3,925,991 | 12/1975 | Poche . | |
| 3,983,830 | 10/1976 | Morgan . | |
| 4,064,820 | 12/1977 | Vogt | 114/74 R |
| 4,075,971 | 2/1978 | Reginensi et al. . | |
| 4,254,730 | 3/1981 | Crenshaw | 114/294 |
| 4,348,282 | 9/1982 | Fries et al. | 114/77 R |
| 4,714,042 | 12/1987 | Schulte . | |
| 4,878,864 | 11/1989 | Van Bentem | 440/5 |
| 4,889,447 | 12/1989 | Strange . | |
| 4,928,613 | 5/1990 | Rudolf . | |
| 4,959,143 | 9/1990 | Koster . | |
| 5,150,661 | 9/1992 | Rudolf . | |
| 5,203,271 | 4/1993 | Chapman . | |
| 5,259,647 | 11/1993 | Sanden | 280/414.1 |

FOREIGN PATENT DOCUMENTS

1232561A1 5/1986 U.S.S.R. .

OTHER PUBLICATIONS

Robishaw Engineering, Inc. Flexifloat catalog, Mar. 21, 1982.
Six sheets of color photographs.

*Primary Examiner*—Sherman Basinger
*Attorney, Agent, or Firm*—Finnegan, Henderson, Farabow, Garrett & Dunner

[57] ABSTRACT

An oil spill recovery shuttle barge system is provided to clean up marine spills. A first barge includes at least two substantially identical pontoons detachably joined in side by side relationship. A second barge includes at least two additional, substantially identical pontoons detachably joined in side by side relationship. A detachable thrust unit and a detachable crane can be mounted to either of the two substantially identical barges, one barge serving as a powered pumping and receiving barge, and the other a nonpowered receiving barge, with the barges capable of being interchanged. The pontoons are flat bottomed, and the thrust unit has an adjustable-depth propeller. The thrust unit has a non-sparking electrical system. The detached pontoons are dimensioned to be transported overland to a marine spill site.

20 Claims, 10 Drawing Sheets

OIL SPILL RECOVERY SHUTTLE BARGE SYSTEM

BACKGROUND OF THE INVENTION

1. Field of the Invention

The present invention relates to a barge system. More specifically, the present invention relates to an oil spill recovery shuttle barge system comprising a plurality of portable, interchangeable barges for use in cleaning up marine oil spills.

2. Description of the Related Art

Marine spills of oil, petroleum, and other products pose significant ecological problems. Several major marine spills in recent years have proven to be disastrous to the environment, wildlife, and local economies along the affected coast lines.

Several types of oil spill recovery vessels are known, including a variety of ships, boats, and barges, having differing capabilities and hull shapes. These vessels typically use an array of equipment including skimming devices, pumps, cranes, and oil storage tanks to accomplish their recovery task.

Existing oil spill recovery vessels, however, suffer from a variety of shortcomings which limit their use in many marine spill environments. The majority of vessels, for example, are relatively non-portable. If a marine spill occurs in waters inaccessible from the navigable waters in which the vessel is located, the vessel cannot reach the scene of the spill. Existing vessels, moreover, typically are not equipped to operate in extremely shallow water, such as very close to a coast line.

Most existing vessels are not equipped to operate in a Grade B spill environment, which is a spill containing flammable liquids such as gasoline or kerosene.

Existing vessels also have a limited storage capacity, requiring them to leave the scene of a marine spill to discharge the recovered oil products, which results in a much longer period of time to complete cleanup of the spill. This longer period is particularly troublesome because, during the delay, the spill continues to spread and/or sink to the bottom.

Coast Guard regulations and lessons learned from cleaning up past marine spills near shore indicate a need for a marine spill recovery vessel capable of: responding to spills in shallow waters; being quickly and safely assembled; operating in one to two feet of water with a swift current; beaching without damage to the vessel hull; anchoring in a fashion that permits the vessel to get underway rapidly; recovering Grade B spill contaminants; being transportable over roads without special permits; and working continuously to recover spilled contaminants with minimal stopping to discharge recovered products.

SUMMARY OF THE INVENTION

To achieve the foregoing objects, and in accordance with the purposes of the invention as embodied and broadly described herein, an oil spill recovery shuttle barge system is provided, having the features described below.

In accordance with the invention, an oil spill recovery shuttle barge system comprises at least a first and a second barge, a detachable thrust unit, a detachable crane, and at least one detachable hose. The first barge comprises at least first and second substantially identical pontoons detachably joined in side by side relationship. Each of the first and second pontoons includes a storage tank, a means for joining the respective pontoon to another pontoon, a means for mounting the thrust unit on the respective pontoon, and a means for mounting the crane on the respective pontoon. The second barge comprises at least third and fourth substantially identical pontoons detachably joined in side-by-side relationship. Each of the third and fourth pontoons also includes a storage tank, a means for joining the respective pontoon to another pontoon, a means for mounting the thrust unit on the respective pontoon, and a means for mounting the crane on the respective pontoon.

The third and fourth pontoons are substantially identical to the first and second pontoons, respectively, and the thrust unit mounting means and crane mounting means on the third and fourth pontoons are substantially identical to the thrust unit mounting means and crane mounting means on the first and second pontoons, respectively. The detachable thrust unit is mountable to either the thrust unit mounting means on the first barge or the thrust unit mounting means on the second barge. The detachable crane is mountable to either the crane mounting means on the first barge, or the crane mounting means on the second barge. The at least one detachable hose is provided for connecting one barge to a storage tank of the other barge.

The oil spill recovery shuttle barge system of the present invention preferably comprises at least a third barge comprising at least fifth and sixth substantially identical pontoons detachably joined in side-by-side relationship. Each of the fifth and sixth pontoons includes a storage tank, a means for joining the respective pontoon to another pontoon, a means for mounting the thrust unit on the respective pontoon, and a means for mounting the crane. The fifth and sixth pontoons are substantially identical to the first and second pontoons, respectively, and the third and fourth pontoons, and the thrust unit means and crane mounting means on the fifth and sixth pontoons are preferably identical to the thrust unit mounting means and the crane mounting means on the first and second pontoons, respectively, and the third and fourth pontoons, respectively.

The shuttle barge system of the present invention preferably includes a fourth barge comprising seventh and eighth identical pontoons detachably joined in side-by-side relationship, being substantially identical to the respective pontoons and barges described above.

In accordance with the invention, the system further includes a skimming assembly for cleaning up a marine spill, and a pumping and transfer assembly. The thrust unit further includes a non-sparking electrical system, enabling the oil spill recovery shuttle barge system to operate in Grade B marine spills.

The pontoons are preferably flat-bottomed, and the thrust unit includes an adjustable propeller which can be set at a depth above the hull bottom, enabling the oil spill recovery shuttle barge system to operate in shallow water, preferably as little as one foot of water.

The oil spill recovery shuttle barge system of the invention further comprises a trailer for stowing and transporting the detached pontoons. The pontoons are sized to fit aboard the trailer. The pontoons and trailer are dimensioned to enable the entire system to be transported without permits overland to various spill sites.

Additional objects and advantages of the invention will be set forth in the description which follows, and in part will be obvious from the description, or may be learned by practice of the invention. The objects and advantages of the invention may be realized and obtained by means of the combinations particularly pointed out in the claims.

DESCRIPTION OF THE DRAWINGS

The accompanying drawings, which are incorporated in and constitute a part of the specification, illustrate preferred embodiments of this invention. Together with the general description given above and the detailed description of the preferred embodiments given below, the drawings serve to explain the principles of the invention.

DETAILED DESCRIPTION OF THE PREFERRED EMBODIMENTS

Reference will now be made in detail to the present preferred embodiments of the invention as broadly illustrated in the accompanying drawings.

Figure 1:
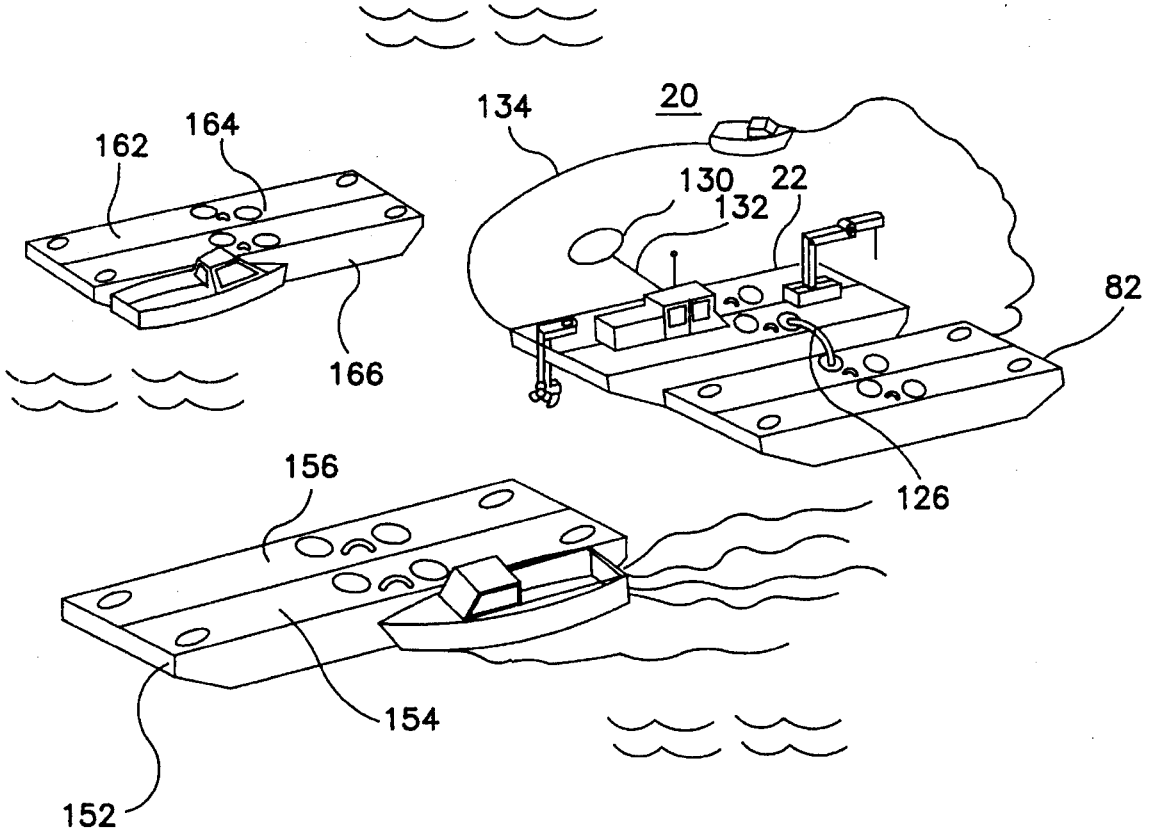
FIG. 1 is a representative view of an oil spill recovery shuttle barge system in accordance with the present invention operating to clean up a marine spill.

An oil spill recovery shuttle barge system is depicted broadly in FIG. 1 and designated by reference numeral 20.

In accordance with the invention, an oil spill recovery shuttle barge system includes a first barge comprising at least first and second substantially identical pontoons detachably joined in side-by-side relationship, each of the first and second pontoons including a storage tank, a means for joining the respective pontoon to another pontoon, a means for mounting a thrust unit on the respective pontoon, and a means for mounting a crane on the respective pontoon. As broadly embodied herein, and referring to FIG. 2, first barge 22 includes a first pontoon 24 and a second pontoon 26. First and second pontoons 24, 26 are substantially identical to one another (with certain exceptions being possible as explained below).

Preferably, each pontoon is constructed of steel frames and steel plates, has a length of 47'10", a maximum width of 8'0", and a depth of 3'10". The bulkheads, deck, and bottom are all stiffened with steel plate, which preferably is ¼" thick on deck and bottom, and 3/16" on the sides. Experiments with the barge indicates that this plate thickness is sufficient to enable the barge to be beached without harm to the barge structure. With pontoons 24, 26 joined together to form barge 22, the barge preferably has a light mean draft of 0'11", a loaded mean draft of 2'10", and displaces 15.87 tons. Each pontoon is further configured with a coaming 25 surrounding the deck to act as a containment for accidental oil spillage on the deck.

Figure 13:
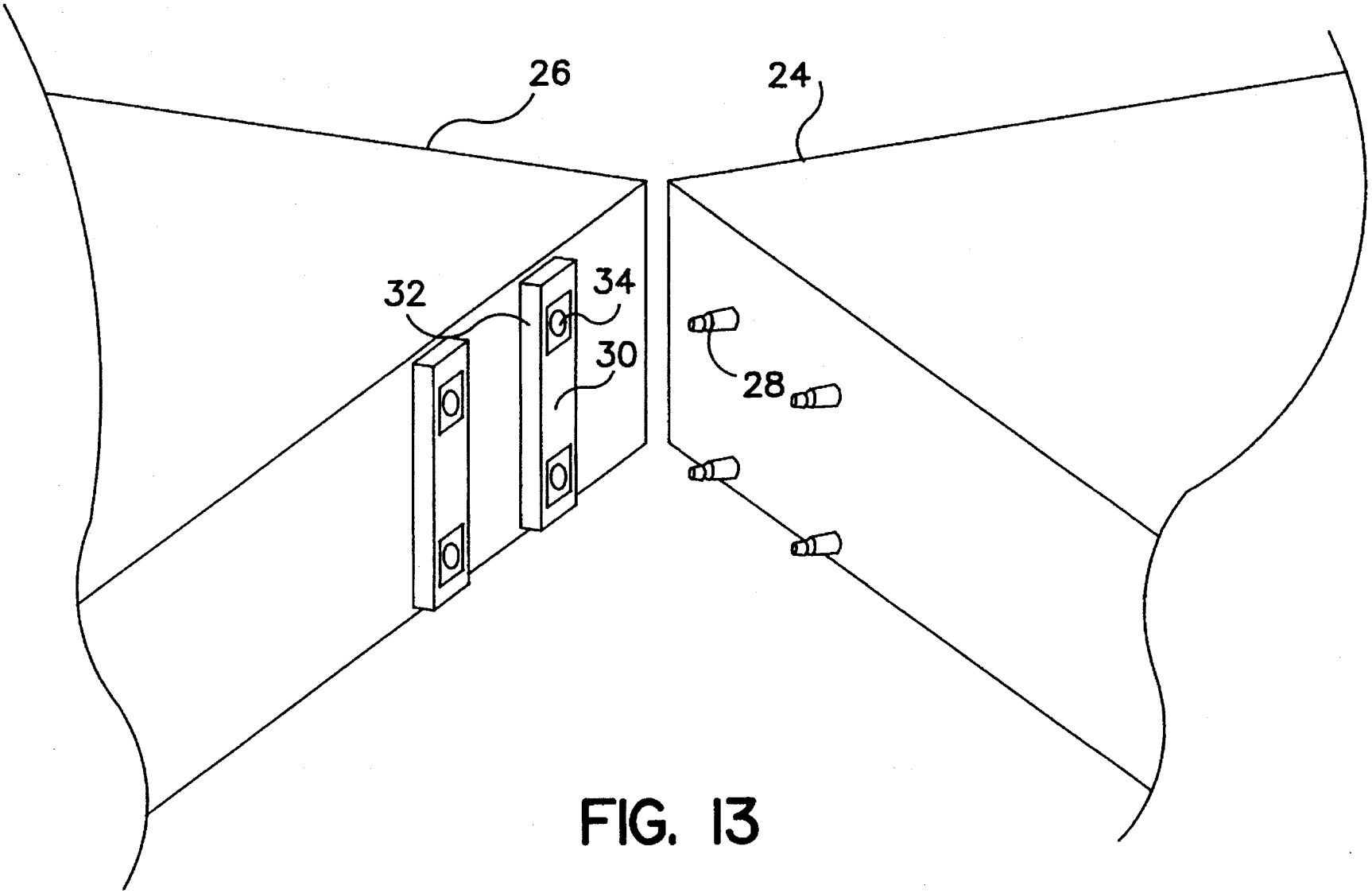
FIG. 13 is a perspective view depicting one possible means for joining two pontoons together in accordance with the invention.

Suitable means for joining the two pontoons together are depicted broadly in FIG. 13. As broadly embodied herein, one suitable joining means includes sets of aligned male connectors 28 projecting from the sides of the pontoons aligned with vertical lock connectors 30 on the adjacent pontoon. Each vertical lock connector 30 includes a slidable spring-loaded locking bar 32 and female receptacle 34. The locking bar 32 is adapted to be slid upward against its spring force, enabling the male connectors 28 to insert into aligning female receptacles 34. Locking bar 32 slides downward to lock male connector 28 in place and securely join the pontoons in side-by-side relationship. A suitable locking system similar to that described above is the FLEXILOCK SYSTEM (tradename) which is commercially available from Robishaw Engineering, Inc. This joining arrangement is preferable because it detachably connects the pontoons into a single barge, with adjacent decks and adjacent bottoms reasonably flush with one another. However, while a pin and lock connector system is described above, this is not the only acceptable joining means. Any equivalent system of clamps, locking pins, or the like which can detachably join the pontoons together, with the adjoining decks and adjoining bottoms reasonably flush with one another, is also acceptable and within the scope of the invention.

Figure 12:
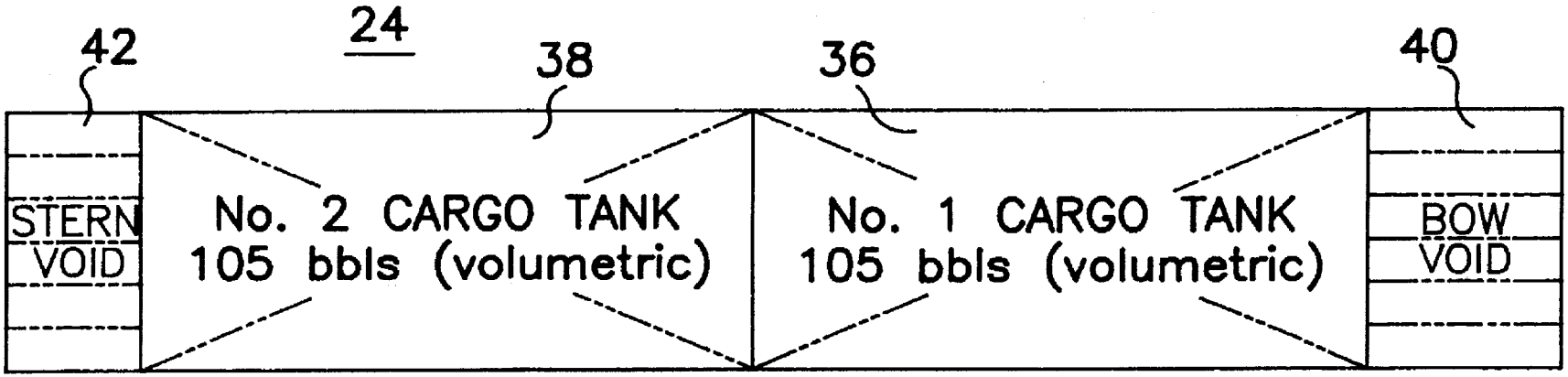
FIG. 12 is a diagram of the storage tank plan for each pontoon in accordance with the invention.

As broadly embodied herein, a storage tank is provided with each pontoon. It is further preferred that two storage tanks be provided with each pontoon. Referring to FIG. 12, fore and aft storage tanks 36, 38 are provided, in addition to void spaces 40, 42 fore and aft, respectively. Each storage tank preferably has a volume of approximately 600 cubic feet, equating to a capacity of 105 barrels of oil, hence providing each pontoon a capacity of 210 barrels, and each assembled barge a capacity of 420 barrels.

Figure 5:
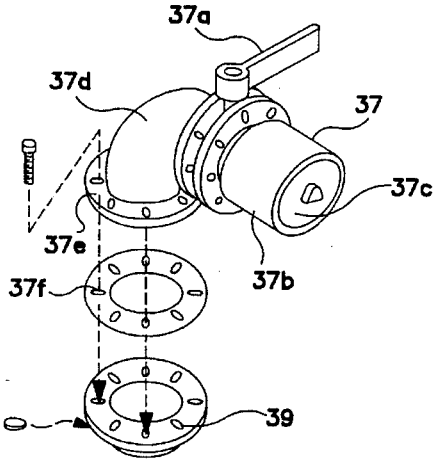
FIG. 5 is a detailed perspective view depicting installation of a fill/discharge valve assembly on a barge in accordance with the invention.
Figure 6:
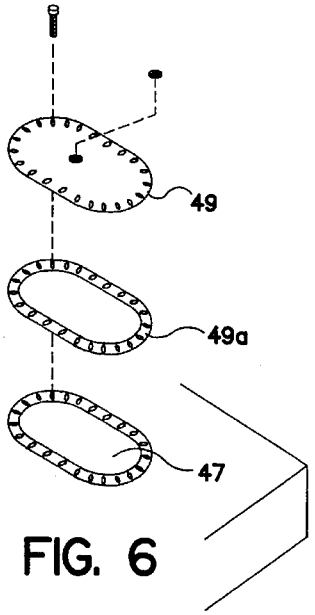
FIG. 6 is a detailed perspective view depicting installation of a manway cover on a barge in accordance with the invention.
Figure 7:
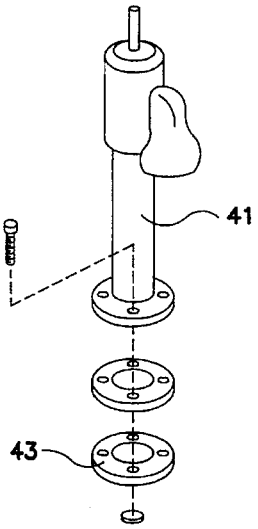
FIG. 7 is a detailed perspective view depicting installation of a pressure/vent valve assembly on a barge in accordance with the invention.

As broadly embodied herein, each tank on each pontoon is provided with a fill/discharge valve assembly and a pressure/vent valve assembly. Referring to FIG. 5, a fill/discharge valve assembly 37 is attachable to an aperture 39 opening into each storage tank. Preferably, fill/discharge valve assembly 37 comprises a 6" butterfly valve 37*a*, a camlock 37*b*, dust plug 37*c*, a piping elbow 37*d*, flange 37*e*, and gasket 37*f*. Additionally, a cover plate (not shown) preferably seals aperture 39 when the fill/discharge valve assembly is not installed. Referring to FIG. 7, each storage tank further includes a 2½" pressure/vent valve assembly 41 attachable to an aperture 43. As with the fill/discharge valve assembly, a cover plate (not shown) preferably covers aperture 43 when the pressure/vent valve assembly is not attached. The respective fill/discharge and pressure/vent valve assemblies are installed whenever oil or the like is pumped to or from the respective storage tanks. Each storage tank preferably includes a 24"×24" flush deck hatch 45 containing an 8" diameter ullage opening with a flame screen. Each void space preferably includes an elliptical manway 47 with a detachable manway cover 49, and a gasket 49*a*, as shown in FIG. 6.

Figure 2:
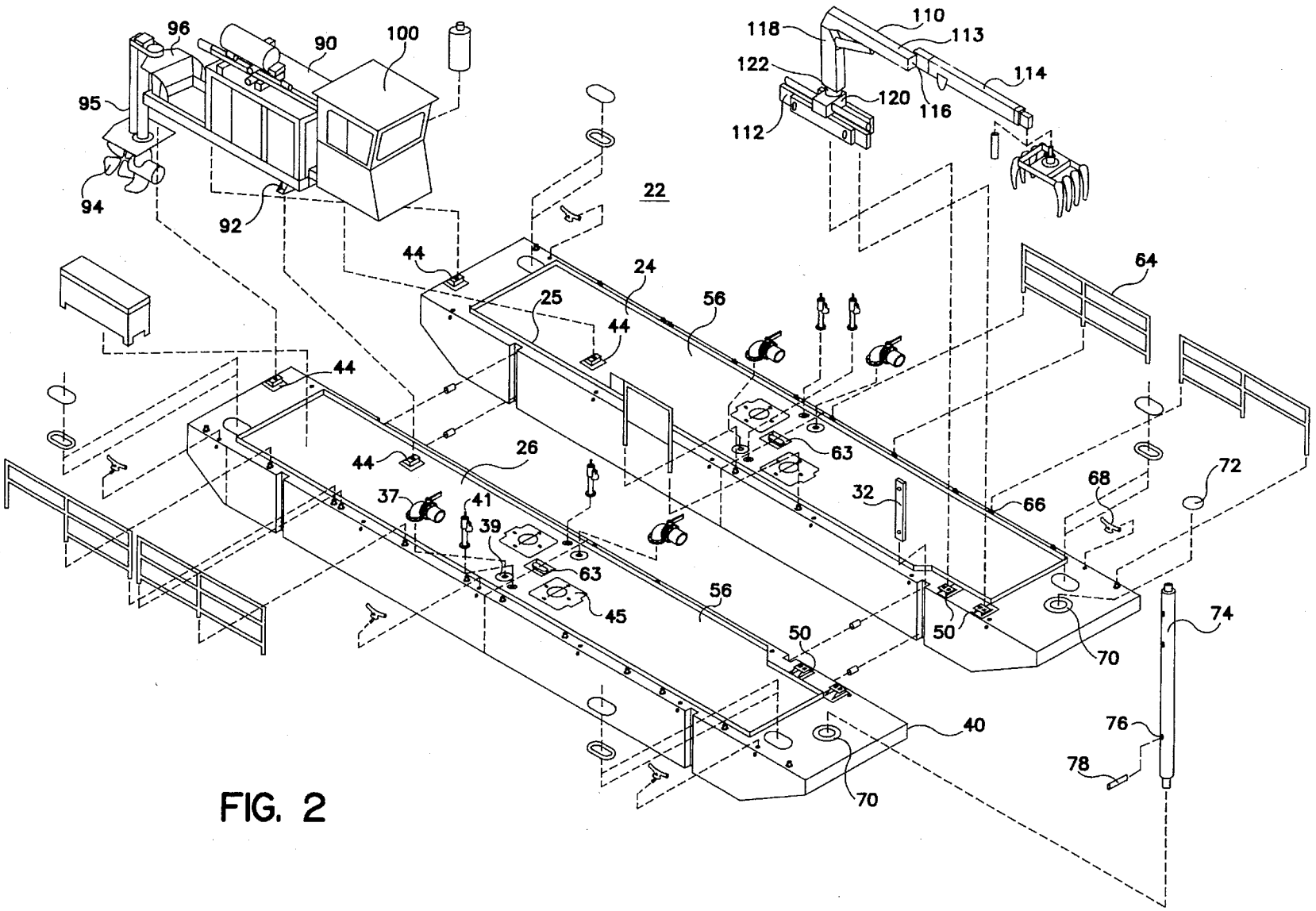
FIG. 2 is a perspective view of one barge of an oil spill recovery shuttle barge system in accordance with the invention, including two detachable pontoons, a detachable thrust unit, and a detachable crane.
Figure 3:
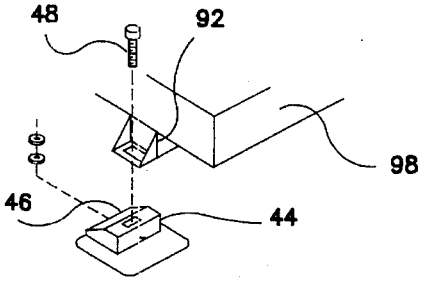
FIG. 3 is a detailed perspective view depicting installation of a thrust unit to a thrust unit mounting means on each pontoon.
Figure 4:
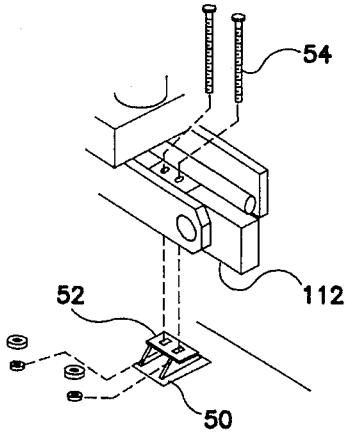
FIG. 4 is a detailed perspective view depicting installation of a crane to a crane mounting means on each pontoon.

Each pontoon 24, 26 further includes means for mounting a thrust unit and means for mounting a crane. Referring to FIGS. 2 and 3, at least two deck pads 44, each having a threaded aperture 46, each receive a bolt 48 for releasably connecting flanges 92 of a thrust unit 90 to a respective deck pad. At least two aligned deck pads 44 per pontoon are positioned proximate adjacent sides near the stern of the two pontoons for attaching thrust unit 90. Referring to FIGS. 2 and 4, additional deck pads 50, containing a pair of threaded apertures 52 for receiving bolts 54, releasably fix a crane 110 to a pontoon. At least two aligned deck pads 52 are positioned proximate adjacent sides near the bow of the two pontoons for attaching crane 110.

Figure 9:
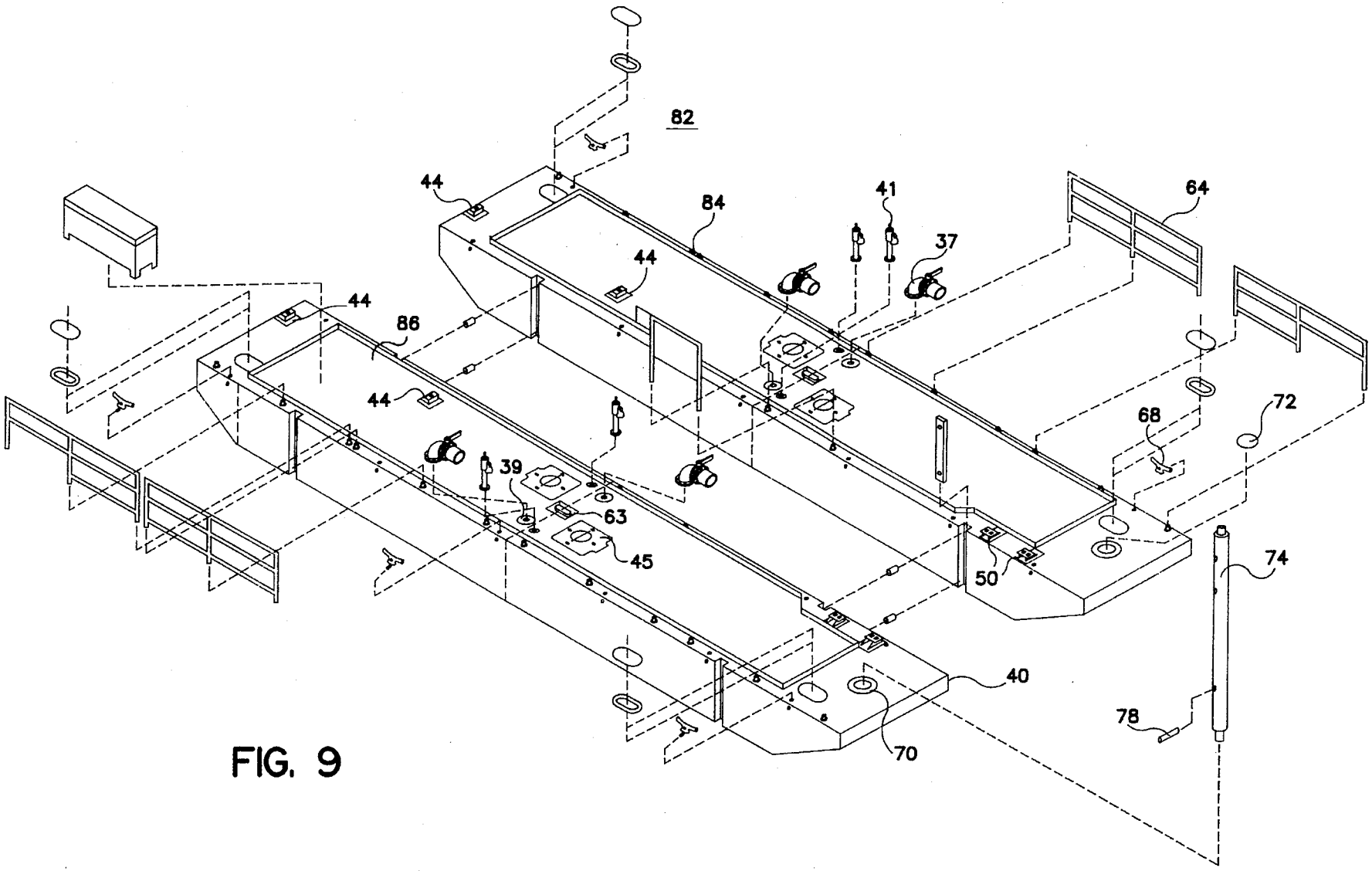
FIG. 9 is a perspective view of another barge in accordance with the invention, including two detachable pontoons, but no thrust unit or crane.
Figure 10:
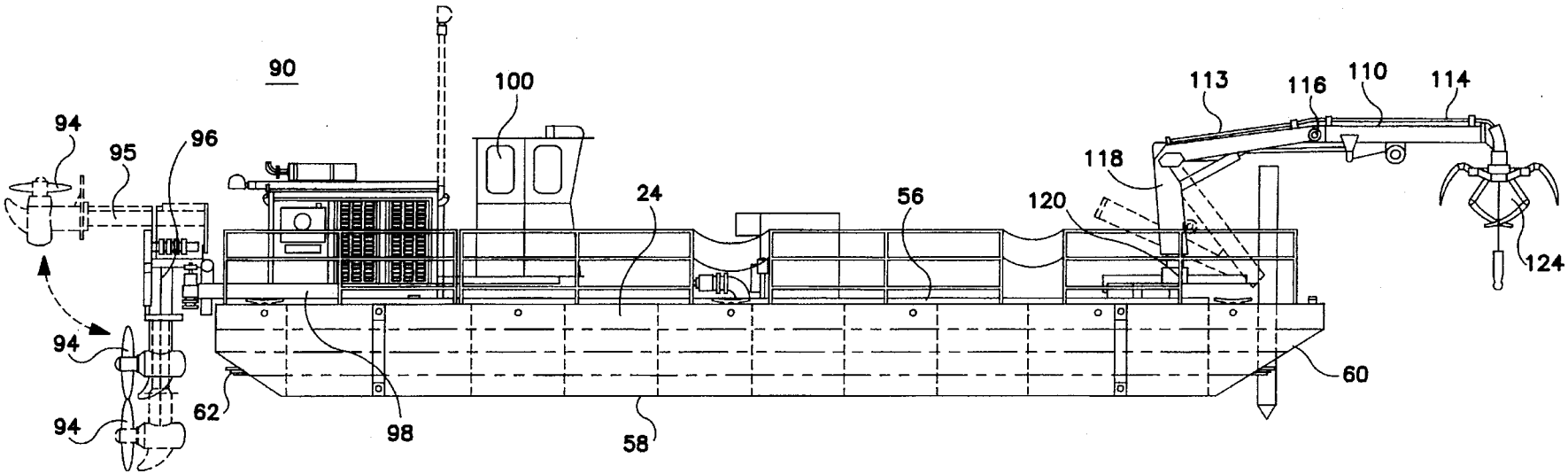
FIG. 10 is a side view of a barge in accordance with the invention with a thrust unit and a crane mounted thereon, further depicting a kick-up capability and a variable-depth capability of the propeller.
Figure 11:
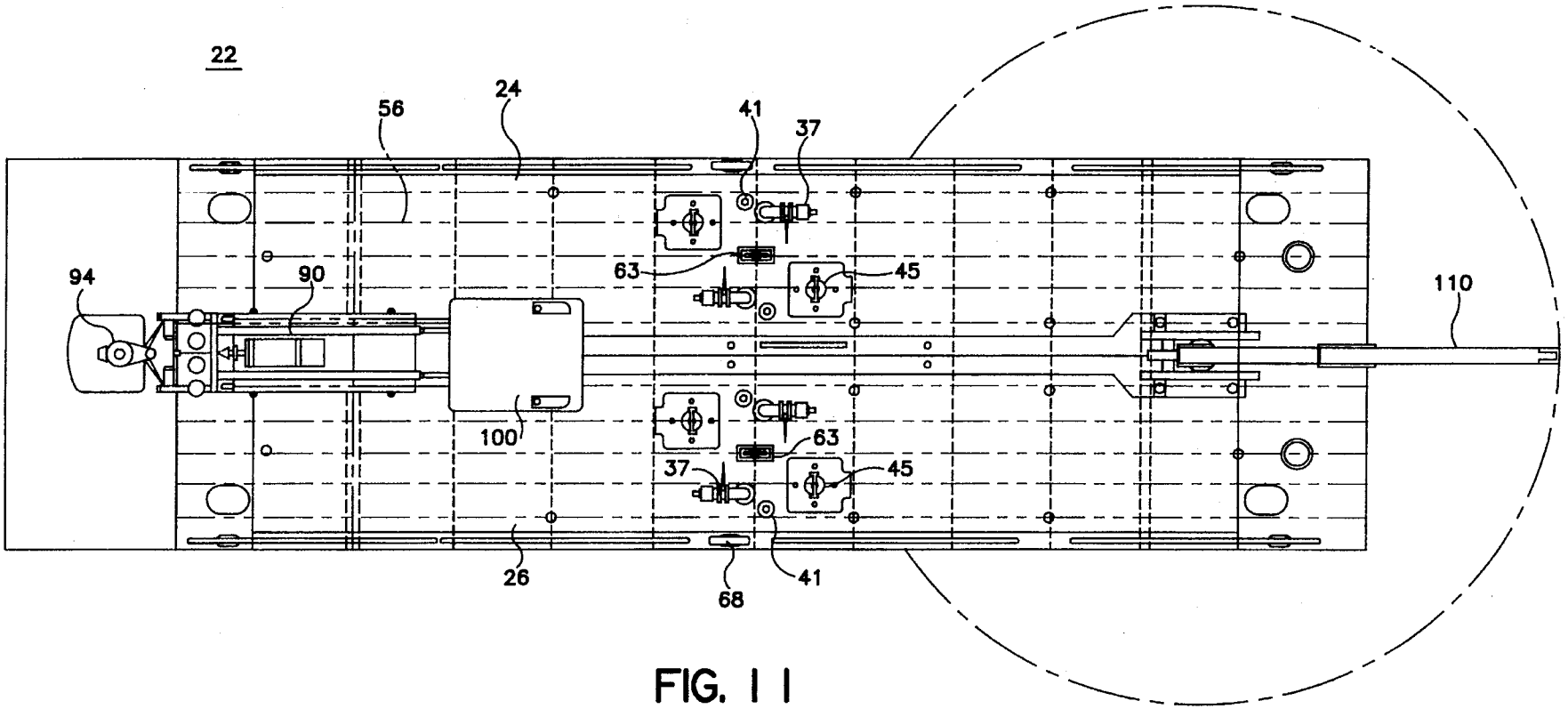
FIG. 11 is a top plan view of the main deck of a barge in accordance with the invention with a thrust unit and a crane mounted thereon.

The preferred shape of each pontoon and barge is broadly depicted in FIGS. 2, 9 and 10. Each pontoon preferably has a substantially flush deck 56, a substantially flat bottom 58, and a raked bow and stern, 60, 62, respectively. As broadly embodied in FIG. 10, the rake of the bow 60 is greater than the rake of the stern 62. The reduced rake of the stern provides stability to the barge when a thrust unit is attached at the stern.

It is further preferred that each pontoon be configured with its center of gravity in the center of the pontoon. Referring to FIG. 2, a deck fitting 63 is provided in the center of the deck 56. Deck fitting 63 provides a lifting point where the pontoon can be lifted with a single sling attached to a crane, with the pontoon perfectly balanced, thereby enabling rapid deployment of the barges at the marine spill site.

Figure 8:
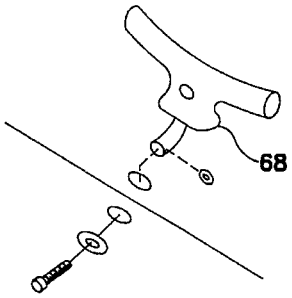
FIG. 8 is a detailed perspective view depicting installation of a deck cleat on a barge in accordance with the invention.

As embodied herein, and referring to FIG. 2, substantially all of the deck equipment on each barge is detachable, and can be installed when the pontoons are placed in the water. Preferably, a plurality of guard rails 64 are provided which can be attached or removed from the deck of each pontoon by insertion in appropriate apertures 66. Likewise, a plurality of deck cleats 68 can be attached or removed from the deck of each barge by insertion of screws into the appropriate deck fittings, as shown in FIGS. 2 and 8.

As broadly embodied herein, each pontoon of each barge further includes an anchoring device. Referring to FIG. 2, the void space 40 located at the bow of each pontoon is penetrated by a spudwell 70. To anchor the barge to a soft bottom, an elongated "spud" 74, or cylindrical stake is provided. Various length spuds can be used with the invention, depending on the depth of water in which the barge will operate. Each spud 74 includes a series of apertures 76 and a crosspiece 78 insertable through a selected one of the apertures. In operation, spudwell cover 72 is removed, and spud 74 is inserted through the spudwell 70 into the bottom, with crosspiece 78 inserted in one aperture 76 to prevent the barge floating off of the spud. In this manner, the barge can be effectively anchored to the bottom. The barge can also get underway very quickly simply by pulling spud 74 back up through spudwell 70, thereby freeing the barge.

As broadly embodied in FIG. 2, first and second pontoons 24 and 26 are substantially mirror images of one another. That is, certain fittings placed on the starboard side of deck 56 on pontoon 24 are placed on the corresponding port side of deck 56 on pontoon 26, e.g., deck pads 44 and 50. However, it is also within the scope of the invention to make each pontoon an exact duplicate of the other, such as by placing deck pads 44 and 50 on each side of the deck, so that either pontoon can be the starboard pontoon, and either pontoon can be the port pontoon.

In accordance with the invention, the oil spill recovery shuttle barge system includes a second barge comprising at least third and fourth substantially identical pontoons detachably joined in side by side relationship, each of the third and fourth pontoons including a storage tank, a means for joining the respective pontoon to another pontoon, a means for mounting a thrust unit on the respective pontoon, and a means for mounting a crane on the respective pontoon, the third and fourth pontoons being substantially identical to the first and second pontoons, respectively. The thrust unit mounting means and crane mounting means on the third and fourth pontoons are substantially identical to the thrust unit mounting means and crane mounting means on the first and second pontoons, respectively. As broadly depicted in FIG. 9, a second barge 82 includes a third pontoon 84 and a fourth pontoon 86. Third and fourth pontoons 84, 86 are substantially identical to one another, with certain exceptions, and additionally are substantially identical to first and second pontoons 24, 26, respectively. As described earlier with respect to first and second pontoons 24, 26, third and fourth pontoons 84, 86 can be mirror images of one another or completely identical to one another.

In accordance with the invention, a detachable thrust unit is mountable to either the thrust unit mounting means on the first barge, or the thrust unit mounting means on the second barge. As broadly embodied in FIGS. 1 and 3, thrust unit 90 is mountable on deck pads 44 of the first barge 22, with bolts 48 inserted through brackets 92 into threaded apertures 46. Alternately, thrust unit 90 can be mounted to the deck pads 44 of the second barge 82. Hence, either of the first or second barges can serve as a powered unit, with the other being a non-powered unit.

In accordance with the invention, thrust unit 90 further is mountable to deck pads 44 on a third barge, which will be described in greater detail below.

As broadly depicted in FIG. 10, thrust unit 90 is a completely self-contained skid-mounted marine propulsion unit, provided with lifting lugs (not shown) for easy handling and transportation. Thrust unit 90 is provided with at least four (4) mounting brackets 92 for attachment to the deck of the selected barge.

Preferably, thrust unit 90 is hydraulically powered. A high efficiency closed loop hydraulic transmission system is used to drive a propeller 94, facilitating fully proportional speed control of propeller 94 in forward and reverse directions regardless of the diesel engine speed. The hydraulic drive acts as a torque converter, allowing utilization of full engine horsepower both in light draft and fully loaded vessel conditions. The main propeller drive is provided with a pressure compensation mechanism positively limiting output torque, thereby protecting the drive mechanism in case of sudden propeller blockage.

In accordance with the invention, the drive of propeller 94 is provided with a hydraulically-operated depth adjustment feature. Referring to FIG. 10, propeller 94 can be operated at a first depth below the bottom 58 of the respective barge. The propeller 94 and its vertical stem 95 also can be raised to a selected second depth as warranted by the depth of water in which the barge will operate, or as the draft of the barge increases with increasing load. The adjustable depths include a depth above the bottom 58 of the barge, as shown in FIG. 10. Preferably, the hydraulic depth adjustment mechanism includes hydraulic reliefs enabling propeller 94 to be forced upwards if it hits bottom. As further depicted in FIG. 10, thrust-unit 90 preferably is provided with a hydraulic kick up unit 96, including a hinge and bearing assembly, which enables propeller 94 and its stem 95 to pivot up out of the water altogether. It is further preferred that hydraulic kick up unit 96 include hydraulic reliefs, allowing the drive unit to pivot upwards in the event it hits bottom. The kick up unit should also be provided with counterbalance valves to allow shock-free kickup, from the vertical position to the fully horizontal position, even under full propeller load.

Preferably, thrust unit 90 is powered by a diesel engine. A suitable engine is the Model 3208T manufactured by the Caterpillar Corporation. In a preferred embodiment, thrust unit 90 includes a 12 volt, non-sparking DC battery provided inside a heavy duty polyethylene battery box, with bronze-armored battery cables. A brushless, belt-driven alternator charges the battery and the entire electrical system is grounded. The engine cooling system preferably includes a non-sparking suction fan, and all belts are conducting and static free. The exhaust system preferably includes a spark-arresting muffler in the exhaust manifold. All of the above features, plus others which will be recognized by persons of skill in the art, are significant to allow the oil spill recovery shuttle barge system to operate safely in a flammable or explosive environment, such as a Grade B marine spill.

Thrust unit 90 is mounted on a fabricated steel platform 98, which supports the engine, hydraulic system, electrical system, exhaust system, cooling system, propeller and drive shaft. An enclosed pilot house 100 provides 360° of visibility, and houses the steering mechanism for the barge. One suitable thrust unit 90 containing the above features is the WM-200 manufactured by Thrustmaster of Texas, Inc.

In accordance with the invention, a detachable crane is mountable to either the crane mounting means on the first barge or the crane mounting means on the second barge. As broadly depicted herein, and referring to FIGS. 2, 4, and 10, crane 110 includes a mounting beam 112, attachable to threaded apertures 52 of deck pads 50 on either of the first or second pontoons 24, 26 of first barge 22, or the third and fourth pontoon 84, 86 of second barge 82. It is further to be understood that crane 110 can be mounted to a third barge as described below. Generally, crane 110 will be mounted to the same barge as the thrust unit 90.

Preferably, crane 110 is a standard heavy duty knuckle-boom crane powered by an external hydraulic system, with hydraulic power provided by thrust unit 90. Crane 110, as embodied herein, includes a main boom 113 and outer knuckle boom 114, pivotably connected at knuckle boom pin 116. Mast 118 is rotatably mounted to main boom 113, and free to rotate with turn cylinder 120 and rotation bearing 122. One suitable crane for use with the invention is the MCK-N-50 manufactured by the Seattle Crane and Equipment Company.

It is further preferred that a workpiece 124, which may be a grapple or hook, be attachable to crane 110. A grapple is particularly useful for removing contaminated debris, e.g., oil-soaked wood, dead wildlife, and the like from the oil slick.

As broadly embodied herein, a barge loaded with thrust unit 90 and crane 110 has a light mean draft of 1'1", an operational mean draft of 2'8", and displaces 21.6 tons.

In accordance with the invention, at least one detachable hose connects one barge to a storage tank on another barge. As broadly embodied in FIG. 1, a hose 126 is provided connecting first barge 22 to second barge 82, preferably connecting to a respective fill/discharge valve assembly 37 on barge 82 as described below.

In accordance with the invention, a skimmer assembly is provided to clean up a marine spill. As broadly embodied in FIG. 1, a skimmer assembly 130 can be lowered into the spill with crane 110. Skimmer assemblies are well known in the art and are available commercially. A typical skimmer assembly is a "weir" skimmer. This skimmer generally includes a skimming pan which can be adjusted to different depths below the surface, depending on the thickness of the oil slick. A submersible pump in the center of the skimming pan pumps recovered oil via hose 132 to the respective barge. As broadly embodied in FIG. 1, hose 132 attaches to a storage tank on powered barge 22. However, it is within the scope of the invention for hose 132 to be the same as hose 126. In other words, the skimmer assembly can pump directly to unpowered barge 82, with the pumping lineup being varied as desired by the operator. Power for the skimmer assembly 130 is provided by thrust unit 90, and handling support is provided by crane 110. Thrust unit 90 preferably has adequate power to operate all commercially-available skimmers.

Preferably, a buoyant boom is provided. Referring to FIG. 1, boom 134 is placed around the marine spill to contain the oil. Such booms are well known in the art.

In accordance with the invention, a detachable pumping and transfer assembly is provided to move recovered products from one barge to another.

Figure 15:
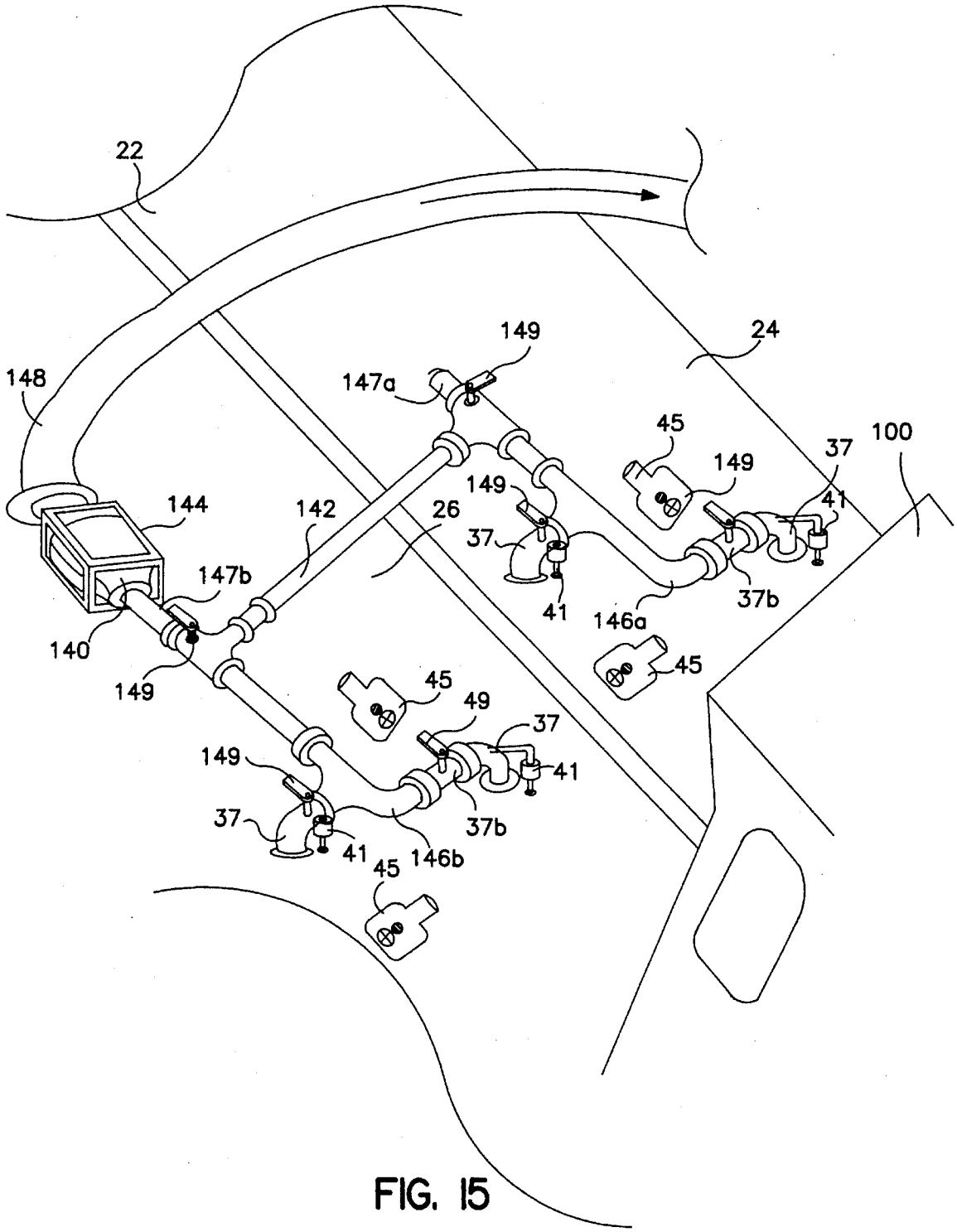
FIG. 15 is a detailed perspective view depicting one embodiment of a detachable pump and discharge manifold assembly in accordance with the present invention.

As broadly embodied herein, a pumping and transfer system 136 includes a pump 140 and discharge manifold 142. Referring to FIG. 15, pump 140, preferably a positive displacement pump, is enclosed in a steel cage 144. Although such a pump is normally operated submerged in fluid, cage 144 enables pump 140 to sit on the deck of the respective barge at the correct height to connect to the manifold 142. Because it is not submerged, pump 142 must have adequate suction head to suck oil out of the storage tanks, and must be lubricated, in order to provide a sealing liquid and prevent damage due to dry running. As embodied herein, water is injected on the discharge side of pump 140 to keep it lubricated. One suitable positive displacement pump is the DOP-250 manufactured by DESMI, Inc.

As embodied in FIG. 15, discharge manifold 142 is generally H-shaped, and dimensioned so that first and second pipe ends **146*a*, 146*b* fit against camlocks 37*b* of the respective fill/discharge valve(s) 37 for each storage tank on each pontoon. Third and fourth pipe ends 147*a*, 147*b* are configured to connect to the suction side of pump 140. A discharge hose 148, which can connect to hose 126 or be the same hose as hose 126, connects to the discharge side of pump 140. Finally, a series of valves 149, which preferably are knife handled gate valves, are provided in the lines of manifold 142 in order to alter the lineup so that pump 140 takes suction on only one storage tank at a time. The advantage of the above-described pump and discharge manifold assembly will be readily understood by one skilled in the art. In previous vessels, discharge of recovered oil and petroleum products required opening the hatch of each storage tank, and manually lowering a pump and discharge hose into the tanks. In order to keep the vessel in trim, the pump periodically had to be removed manually from one tank and transferred to another storage tank. This operation was tedious and resulted in oil being spilled on the deck, creating hazardous working conditions and cleanliness problems. Using the pump and discharge manifold of the present invention, each storage tank can be pumped out without opening hatches or moving the pump from tank to tank. Simply by altering the lineup of valves 149**, different storage tanks can be pumped, changing tanks as necessary to keep the barge in trim, discharging oil more rapidly and without spilling oil on the deck. Furthermore, oil can be pumped from any storage tank on one barge to any storage tank on another barge.

In accordance with the invention, a third barge 152 may be provided, including fifth and sixth pontoons 154, 156. The fifth and sixth pontoons 154, 156 are substantially identical to first and second pontoons 24, 26, respectively, and third and fourth pontoons 84, 86, respectively. It is further preferred that a fourth barge 162, comprising seventh and eighth pontoons 164, 166 be provided, the pontoons being substantially identical to the other sets of pontoons, respectively. One of ordinary skill will readily understand the advantages offered by this arrangement. Any one of the barges can have the thrust unit 90 and crane 110 attached to it. Thus, any barge can be the powered barge, taking the lead in cleaning up a spill, while the other barges can be used as unpowered receptacles for the oil and other recovered chemicals. Moreover, the unpowered receptacle barges can be shuttled back and forth as necessary to offload their contents, without interrupting the spill cleanup operation. The substantially identical construction of the sets of pontoons makes them substantially interchangeable with one another in assembling the various barges. In the case where the port and starboard pontoons mirror one another, for example, pontoon 26 can be interchanged with any of starboard pontoons 86, 156, or 166, and port pontoon 24 can be interchanged with any of port pontoons 84, 154, or 164. In the case where all pontoons are exact duplicates, any of the pontoons can be interchanged, regardless of which side of a barge it will comprise. Moreover, although four barges are shown and described, any number of similar barges can also be provided and used with the invention.

Figure 14:
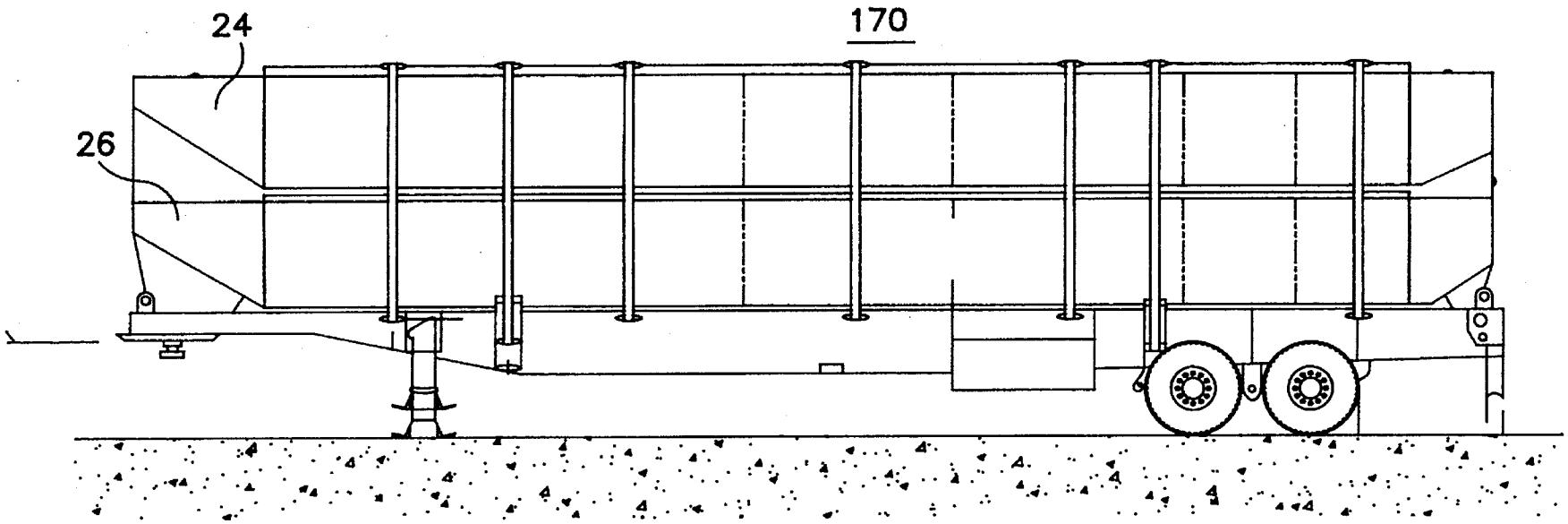
FIG. 14 is a side view of a trailer in accordance with the invention for stowing and hauling detached pontoons.

In accordance with the invention, a trailer is provided to stow and transport each of the detached pontoons. As broadly embodied in FIG. 14, a trailer 170 is provided, including a steel frame configured to stow at least two of the pontoons. It is preferred that each trailer, fully loaded, will make up a load less than 8'6" wide, less than 13'6" high, and less than 48'0" long. A load fitting in this envelope can be transported on highways in all fifty states of the U.S. without obtaining special permits. Use of such trailers enables the disassembled barges to be transported easily to a coast proximate the marine spill site. It is further preferred that a flatbed trailer be provided to transport the thrust unit, crane, skimmer assembly, and so forth.

As broadly embodied herein, the two pontoons of each barge can be joined in the water to form a barge with four cargo tanks. The two pontoons lock together with a proven mechanical pin and gate locking system, and can be joined together in less than five minutes. Every pontoon has mounting positions for installation of a diesel-powered hydraulic barge thruster unit and a hydraulic crane. Any barge in the system may be operated as a powered unit or a nonpowered unit. The powered unit will support a skimmer which will discharge recovered oil, petroleum and other products to either the powered unit or the unpowered unit. However, each barge is completely interchangeable with the other barges, and each pontoon in each set is interchangeable with the corresponding pontoon in the other sets.

At the preposition site, the pontoons are stowed on a specially designed barge-hauling trailers. Two pontoons are stowed per trailer, and the pontoon and trailer make up a load fitting within an envelope which is legal for road-hauling throughout the United States.

When responding to a spill, the trailers are moved to an unloading area near the spill site. A crane can be used to unload the pontoons and place them in the water, where two pontoons are hauled into side-by-side relationship with hand lines. A crewmember opens the locking gate assemblies on one pontoon and allows the locking pin on the other pontoon to enter the open gate. When the locking pins insert fully, the gates are closed, thereby locking the pontoons together. This operation takes less than five minutes.

Crewmembers next install detachable hand rails, deck cleats, and so on on the deck of each barge. The barge which is to be powered receives the thrust unit and hydraulic crane, which are bolted to the respective mounting positions. Installation of each component can be completed in about a half hour. The skimmer is placed aboard, and the unpowered barge is ready to operate. Unpowered barges are also assembled by joining the pontoons, erecting hand rails, deck cleats, and so on. The flat bottom of the hulls and adjustable-depth capability of the propeller permit operation in shallow water. A non-sparking electrical system permits operation in explosive Grade B spills. Each barge can be beached without damage. Use of spuds to anchor each barge allows rapid anchoring and rapid underway. As the storage tanks of any one barge become filled, that barge can be towed away for unloading, and another barge can be moved into its place, thereby allowing continuous cleanup operation without stopping the operation to discharge the recovered products.

The oil spill recovery shuttle barge system described above can be transported to various spill sites. Barges can be assembled quickly out of the multiple detachable, interchangeable parts. The barges can operate in shallow water and in Grade B explosive spills, can be beached without danger to the barge, and can be anchored and gotten underway again quickly and easily. The barges can operate continuously cleaning up a marine spill without breaking off operations due to inadequate storage capacity.

Additional advantages and modifications will readily occur to those skilled in the art. The invention in its broader aspects is, therefore, not limited to the specific details, representative apparatus, or illustrated examples shown and described. Departures may be made from such details without departing from the spirit or scope of the invention, as set forth in the attached claims and their equivalents.

We claim:

1. An oil spill recovery shuttle barge system comprising:

a first barge comprising at least first and second substantially identical non-self propelled pontoons detachably joined-in side by side relationship, each of the first and second pontoons including a storage tank, a means for joining the respective pontoon to another pontoon, a means for mounting a thrust unit on the respective pontoon, and a means for mounting a crane on the respective pontoon;

a second barge comprising at least third and fourth substantially identical non-self propelled pontoons detachably joined in side by side relationship, each of the third and fourth pontoons including a storage tank, a means for joining the respective pontoon to another pontoon, a means for mounting a thrust unit on the respective pontoon, and a means for mounting a crane on the respective pontoon, the third and fourth pontoons being substantially identical to the first and second pontoons, respectively, and the thrust unit mounting means and crane mounting means on the third and fourth pontoons being substantially identical to the thrust unit mounting means and crane mounting means on the first and second pontoons, respectively;

a detachable thrust unit mountable to one of the respective thrust unit mounting means on one of the first and second barges, said thrust unit including a propulsion means for propelling the respective barge;

a detachable crane mountable to one of the respective crane mounting means on the first and second barges; and at least one detachable hose for connecting a storage tank on one barge to a storage tank on the other barge.

2. An oil spill recovery shuttle barge system according to claim 1, further comprising a third barge including at least fifth and sixth substantially identical non-self propelled pontoons detachably joined in side by side relationship, each of the fifth and sixth pontoons including a storage tank, a means for joining the respective pontoon to another pontoon, a means for mounting a thrust unit on the respective pontoon, and a means for mounting a crane on the respective pontoon, the fifth and sixth pontoons being substantially identical to the first and second pontoons, respectively, and the third and fourth pontoons, respectively, the thrust unit mounting means and crane mounting means on the fifth and sixth pontoons being substantially identical to the thrust unit mounting means and crane mounting means on the first and second pontoons, respectively, and the third and fourth pontoons, respectively.

3. An oil spill recovery shuttle barge system according to claim 2, further comprising a fourth barge including at least seventh and eighth substantially identical non-self propelled pontoons detachably joined in side-by-side relationship, each of the seventh and eighth pontoons including a storage tank, a means for joining the respective pontoon to another pontoon, a means for mounting a thrust unit on the respective pontoon, and a means for mounting a crane on the respective pontoon, the seventh and eighth pontoons being substantially identical to the first and second pontoons, respectively, the third and fourth pontoons respectively, and the fifth and sixth pontoons, respectively, the thrust unit mounting means and crane mounting means being substantially identical to the thrust unit mounting means and crane mounting means on the first and second pontoons, respectively, the third and fourth pontoons, respectively, and the fifth and sixth pontoons, respectively.

4. An oil spill recovery shuttle barge system according to claim 1, further comprising a trailer configured to stow and transport two of the detached pontoons.

5. An oil spill recovery shuttle barge system according to claim 1, wherein each pontoon further comprises means for mounting fluid transfer piping on the respective pontoon.

6. An oil spill recovery shuttle barge system according to claim 1, wherein the propulsion means includes a propeller, said propeller being vertically movable with respect to the bottom of the barge to adjust the depth of the propeller in the water.

7. An oil spill recovery shuttle barge system according to claim 1, wherein the propulsion means includes a propeller, said propeller being pivotable about an axis to lift the propeller out of the water.

8. An oil spill recovery shuttle barge system according to claim 1, wherein each pontoon further includes an anchoring device to anchor the respective barge.

9. An oil spill recovery shuttle barge system according to claim 8, wherein the anchoring device includes a spudwell penetrating a bow portion of each pontoon, and a spud extendable through one respective spudwell.

10. An oil spill recovery shuttle barge system according to claim 1, wherein the thrust unit includes a non-sparking electrical system.

11. An oil spill recovery shuttle barge system according to claim 1, wherein each pontoon includes a liftwell assembly at a substantially central portion of a deck.

12. An oil spill recovery shuttle barge system according to claim 1, wherein each pontoon has a bow portion and a stern portion, and a rake of each respective bow portion is greater than a rake of each respective stern portion.

13. An oil spill recovery shuttle barge system according to claim 1, further comprising a detachable pumping and transfer assembly attachable to either respective barge.

14. An oil spill recovery shuttle barge system according to claim 13, wherein the pumping and transfer assembly includes a generally H-shaped discharge manifold, having first and second pipe ends attachable to the storage tanks of two side-by-side pontoons, and a pump attachable to a third pipe end.

15. An oil spill,recovery shuttle barge system according to claim 1, further comprising a skimming assembly from collecting spilled oil.

16. An oil spill recovery shuttle barge system according to claim 1, wherein the crane further includes a grapple for collecting contaminated debris.

17. A method of recovering a marine oil spill, comprising:

transporting first, second, third, and fourth portable substantially identical non-self propelled pontoons to an unloading area, each said pontoon including: a storage tank, a means for joining one respective pontoon to another respective pontoon, and a means for mounting a thrust unit on the respective pontoon;

assembling a first barge by detachably joining together the first and second pontoons;

assembling a second barge by detachably joining together the third and fourth pontoons;

mounting a detachable thrust unit to the thrust unit mounting means on one pontoon of the first barge, the thrust unit including propulsion means for propelling the first barge;

repositioning the first and second barges from the unloading area to an oil spill site; and collecting oil in the storage tank of at least one of the barges.

18. A method according to claim 17, wherein oil is collected in the second barge.

19. A method according to claim 18, further comprising transporting fifth and sixth substantially identical non-self propelled pontoons to the unloading area, and assembling a third barge by detachably joining together the fifth and sixth pontoons.

20. A method according to claim 19, further comprising repositioning the third barge from the unloading area to the oil spill site, and collecting oil in the third barge.

* * * * *